US006786203B1

(12) United States Patent
Vulpillieres et al.

(10) Patent No.: US 6,786,203 B1
(45) Date of Patent: Sep. 7, 2004

(54) INJECTOR VALVE FOR INTEGRATED AIR/ FUEL MODULE

(75) Inventors: Didier Jean de Vulpillieres, Williamsburg, VA (US); Jim Russell Morris, Newport News, VA (US)

(73) Assignee: Siemens VDO Automotive Corporation, Auburn Hills, MI (US)

( * ) Notice: Subject to any disclaimer, the term of this patent is extended or adjusted under 35 U.S.C. 154(b) by 17 days.

(21) Appl. No.: 10/402,969

(22) Filed: Apr. 1, 2003

Related U.S. Application Data

(60) Provisional application No. 60/376,815, filed on Apr. 30, 2002.

(51) Int. Cl.[7] ..... F02M 55/00
(52) U.S. Cl. ..... 123/470; 123/184.61
(58) Field of Search ..... 123/470, 184.61

(56) References Cited

U.S. PATENT DOCUMENTS 4,776,313 A * 10/1988 Freismuth et al. ..... 123/470
4,909,221 A 3/1990 Heuser
5,168,857 A 12/1992 Hickey
5,189,782 A 3/1993 Hickey
5,465,699 A 11/1995 Voigt
5,568,798 A 10/1996 Lorraine
5,657,733 A * 8/1997 Dozier et al. ..... 123/470
5,743,235 A * 4/1998 Lueder ..... 123/468
5,934,252 A 8/1999 Hafner et al.
6,260,537 B1 7/2001 Lamb et al.
6,308,686 B1 * 10/2001 Mammarella et al. ..... 123/470

* cited by examiner

*Primary Examiner*—Thomas Moulis

(57) ABSTRACT

Preferred embodiments of an air-fuel module include a manifold and a valve group subassembly. The manifold has a fuel supply passage, at least one air supply passage, and at least one power group subassembly defining a chamber in communication with the fuel supply passage and the at least one air supply passage. The fuel supply passage extends generally along a first axis. The at least one air supply passage extends between a common air inlet and respective air outlets along a second axis A2 generally orthogonal to the first axis. The valve group subassembly extends along a valve axis between a valve inlet and a valve outlet. The valve group subassembly is adapted to be inserted into the chamber through the respective air outlets. In an alternate embodiment, the power group subassembly is formed separately from the manifold so that the power group subassembly can be inserted into a recess formed in the manifold. A bar member can be used to structurally and electrically interconnect a plurality of power subassemblies. A method of forming the air-fuel module is provided.

31 Claims, 7 Drawing Sheets

100
30
113a
113b
113c
113d
302
300
304
306
106
112'
112'
112'
112'
101
101
101
CM
A2
A1
120
108
101
120
200
200
104
104
104
209
216
216

INJECTOR VALVE FOR INTEGRATED AIR/ FUEL MODULE

PRIORITY

This application claims the benefit under 35 U.S.C. § 119 to provisional application having Ser. No. 60/376,815 entitled "Injector Valve for an Integrated Air/Fuel Module" filed on Apr. 30, 2002, which provisional application is incorporated by reference herein in its entirety in this application.

BACKGROUND OF THE INVENTION

It is believed that in the conventional fuel injection system can be assembled, in part, by mounting an air intake manifold to the intake ports of an engine, inserting the outlet of a fuel injector to an injector boss formed in the intake manifold, and coupling a fuel rail to the fuel injector inlet.

The assembly of the conventional fuel system above is believed to require additional operations. In particular, the inserting of the fuel injector outlet and the injector boss and the fuel injector inlet and the coupling the fuel rail and may require lubrication of respective O-rings between each of the fuel rail and injector boss and possibly adjustments of a clamping force by the fuel rail on the fuel injector and the intake manifold. These types of operation may lead to additional complexity in the manufacturing and assembly of the fuel injection system, which may require human intervention to ensure that there is no leak once the fuel injector is assembled to the intake manifold.

SUMMARY OF THE INVENTION

The present invention provides air-fuel module that comprises a manifold, a power group subassembly and a valve group subassembly. The manifold includes first and second portions. The first portion defines a fuel supply passage and at least one air supply passage. The second portion includes a surface that defines a chamber providing a passageway to allow communication with the fuel supply passage and the at least one air supply passage. The power group subassembly has a coil surrounding the surface. The valve group subassembly is disposed within the chamber.

In yet another aspect, the present invention provides for a method of forming an air-fuel module. The air-fuel module includes a manifold and a valve group subassembly. The manifold includes first and second wall portions. The first wall portion has a fuel supply passage and at least one air supply passage extending between an inlet and an outlet. The second wall portion has a wall surface defining a chamber. The method can be achieved by surrounding the wall surface of the chamber with a coil of a power group subassembly; and inserting the valve group subassembly into the chamber.

BRIEF DESCRIPTIONS OF THE DRAWINGS

The accompanying drawings, which are incorporated herein and constitute part of this specification, illustrate an embodiment of the invention, and, together with the general description given above and the detailed description given below, serve to explain the features of the invention.

DETAILED DESCRIPTION OF THE PREFERRED EMBODIMENTS

Figure 1:
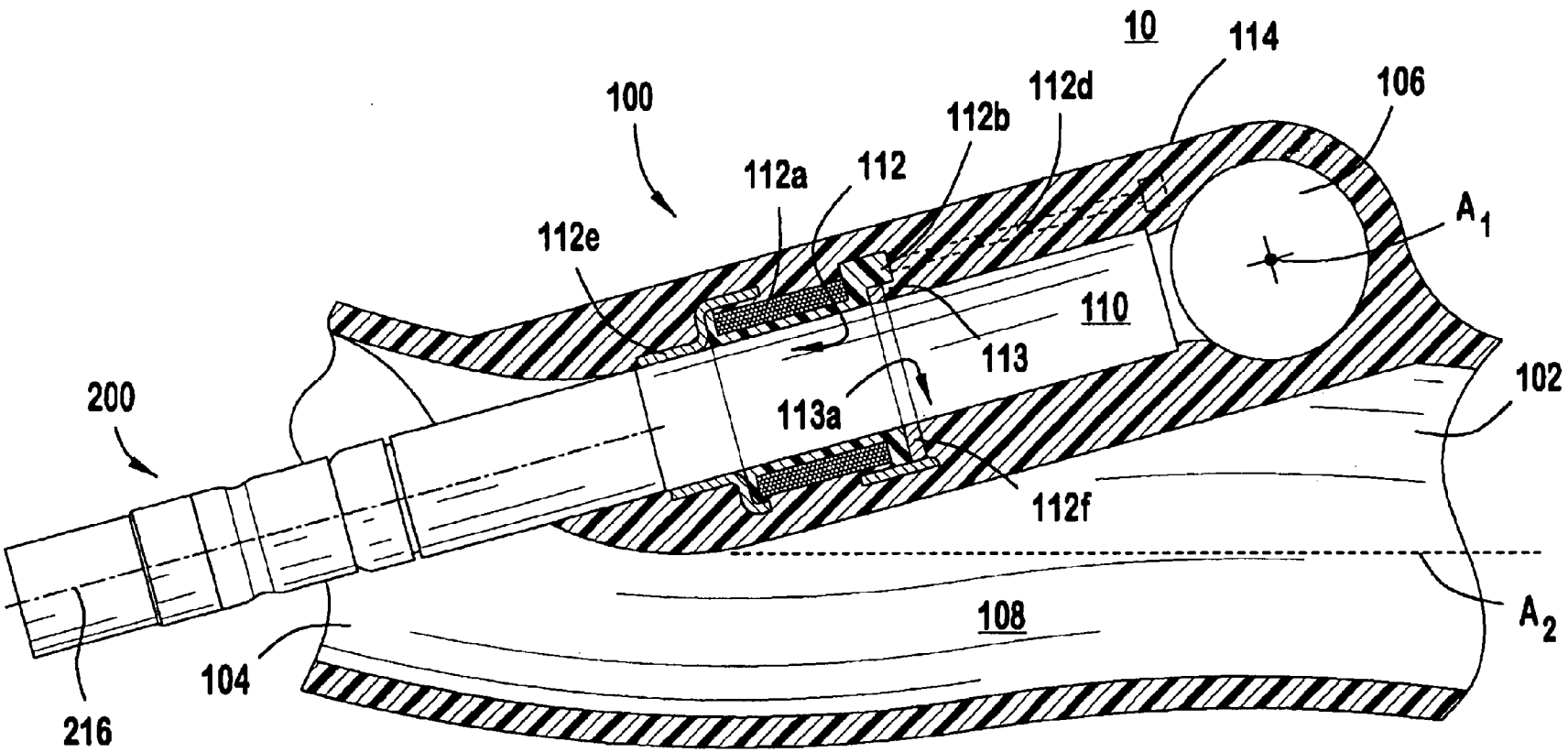
FIG. 1 illustrates a preferred embodiment of the air-fuel module with a valve group subassembly prior to insertion in a manifold from the outlet side of the manifold.

FIGS. 1–4 illustrate the preferred embodiments. In particular, FIG. 1 illustrates an air-fuel module 10 that can include a manifold 100, a power group subassembly 112, and a valve group subassembly 200. The valve group subassembly 200 performs fluid handling functions, e.g., defining a fuel flow path and prohibiting fuel flow through the injector formed between the power group subassembly 112 and the valve group subassembly 200. The power group subassembly 112 performs electrical functions, e.g., converting electrical signals to a driving force that meters fuel through the valve group subassembly 200. The air-fuel module 10, by virtue of the manifold 100, has a common air inlet end 102 and separate air outlets 104. The air outlets 104 of the air-fuel module 10 can be mounted to the respective intake ports (not shown) of a cylinder head of an internal combustion engine (not shown). The air inlet 102 can be mounted to an air filtration or intake assembly (not shown).

The manifold 100 has a fuel supply passage 106 that extends along a first axis A1 in the manifold 100. The manifold 100 also has a plurality of air supply passages 108 that extends generally along a second axis A2 in the manifold 100 between the common air inlet 102 and the respective air outlets 104. The manifold 100 can be formed of a suitable material or a combination of materials that can withstand the operating environment of an automobile engine compartment such as, for example, steel, aluminum, carbon fiber or a polymer. Preferably, the manifold 100 is formed from a molded Nylon 6—6 body that has the first and second axes A1 and A2 orthogonal to each other in the polymeric body.

Disposed between the fuel supply passage 106 and each of the plurality of air supply passages 108 is a chamber 110 that, prior to the valve group subassembly 200 being inserted therein, is in communication with the fuel supply passage 106 and the air supply passages 108. Preferably, the chamber 110 is in the form of a cylindrical chamber with a generally constant cross-sectional area. Surrounding this chamber 110 and second wall portion 113 is the power group subassembly 112 that can be used to actuate the components of a valve group subassembly 200 in order to meter fuel between the fuel supply passage 106 and the air supply passages 108.

The power group subassembly 112 can be overmolded with the manifold so that the second wall portion 113 and a wall surface 113*a* of the chamber 110 and the power group subassembly 112 form a unitary wall 100*a* of the air-fuel module 10. Further, the power group subassembly 112 can be electrically connected to a common electrical harness 114 that can be formed on the module so that the power group subassembly 112 can be individually controlled for injection of fuel.

The power group subassembly 112 can include a suitable electromagnetic coil 112*a* and associated components that generate a magnetic flux upon application of electrical power to the power group subassembly 112. In particular, the electromagnetic coil 112*a* can include a bobbin 112*b* with coil wire windings 112*c* about the bobbin 112*b*. The coil wire 112*c* can be connected to the electrical harness through conductive wire 112*d* disposed within the surface of the manifold 100. The bobbin 112*b* is disposed within a coil housing 112*e*, which is magnetically coupled to a flux washer 112*f* disposed at a distal end of the coil housing 112*e*. The components are assembled and preferably insert molded together with the air-fuel module 10 to form unitary first wall portion 100*a*. Preferably, the power group subassembly 112, including electrical connectors, is calibrated and tested independently of the valve group subassembly 200 after being insert molded as a unitary part of the manifold 100. Details of the power group subassembly 112 or 112', including other preferred embodiments, are described and illustrated in U.S. Patent Publication No. 20020047054, entitled "Modular Fuel Injector And Method Of Assembling The Modular Fuel Injector" and published on Apr. 25, 2002, which is hereby incorporated by reference in its entirety.

Figure 2:
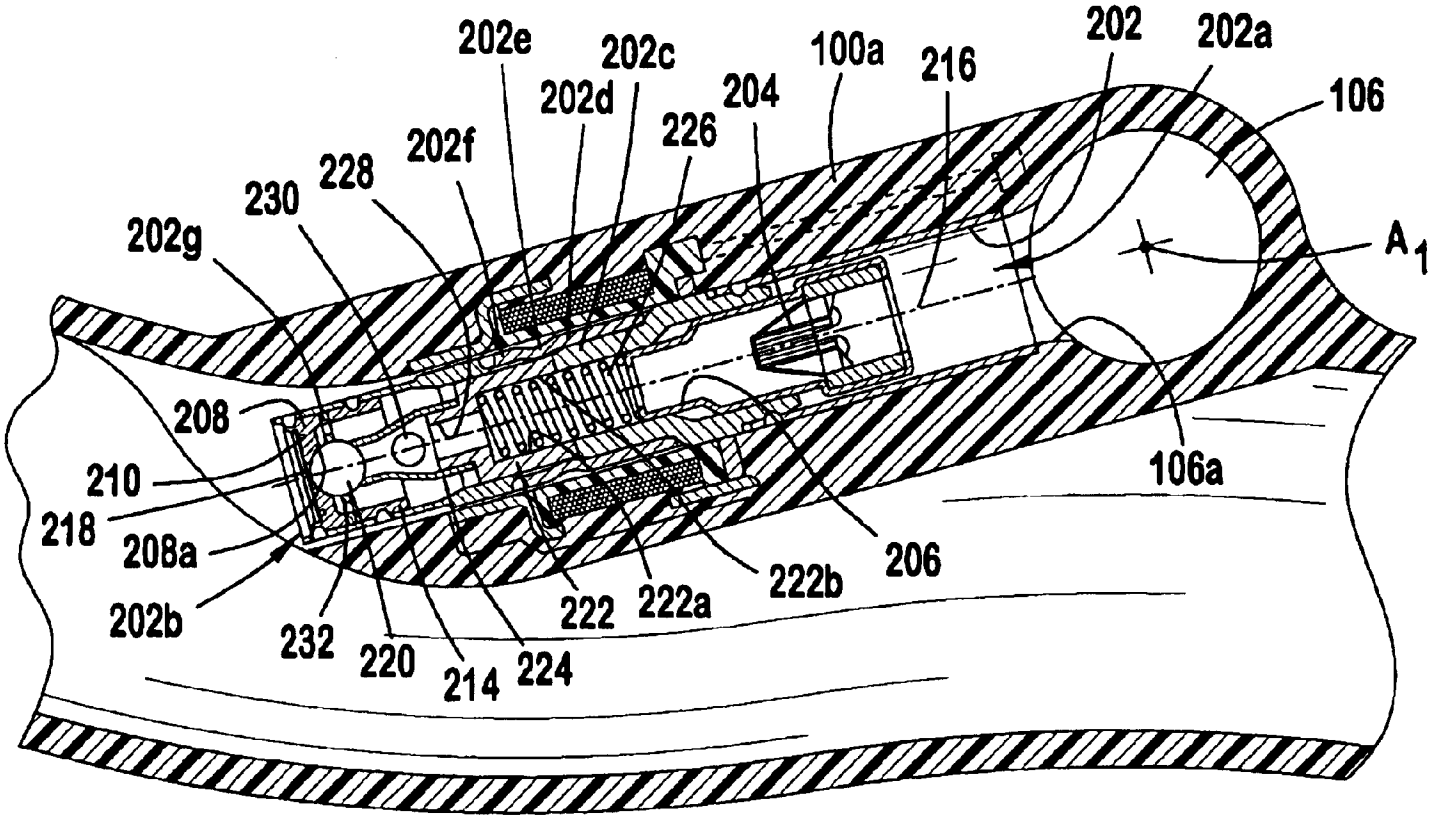
FIG. 2 illustrates the valve group subassembly in its installed position with the manifold.
Figure 2A:
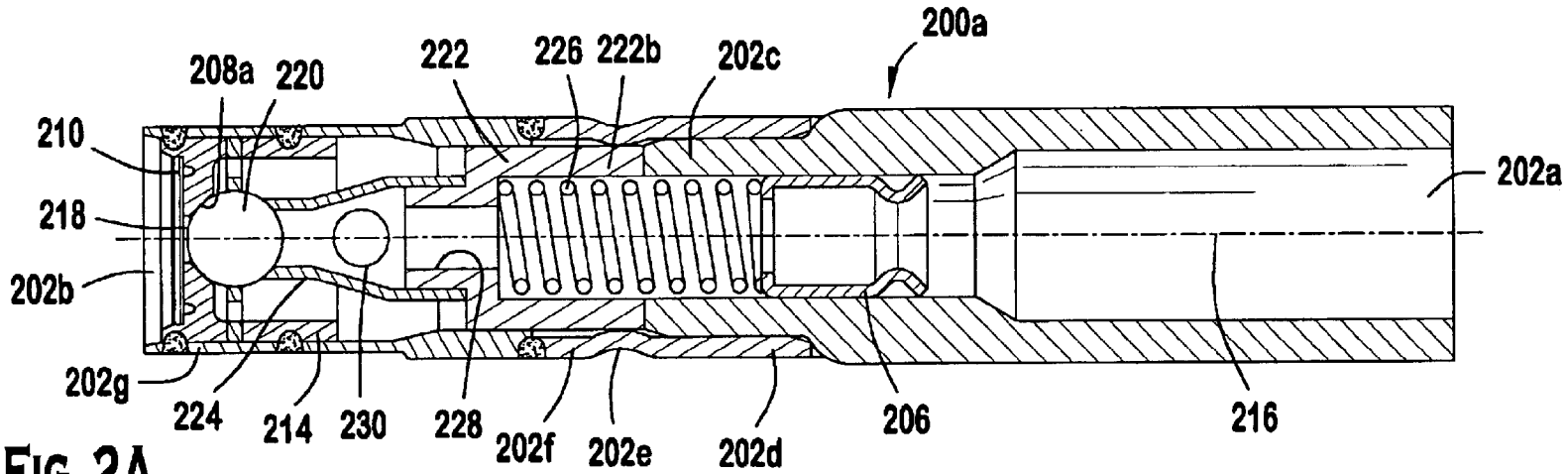
FIG. 2A illustrates a cross-sectional view of the components of the valve group subassembly of FIG. 2.
Figure 2B:
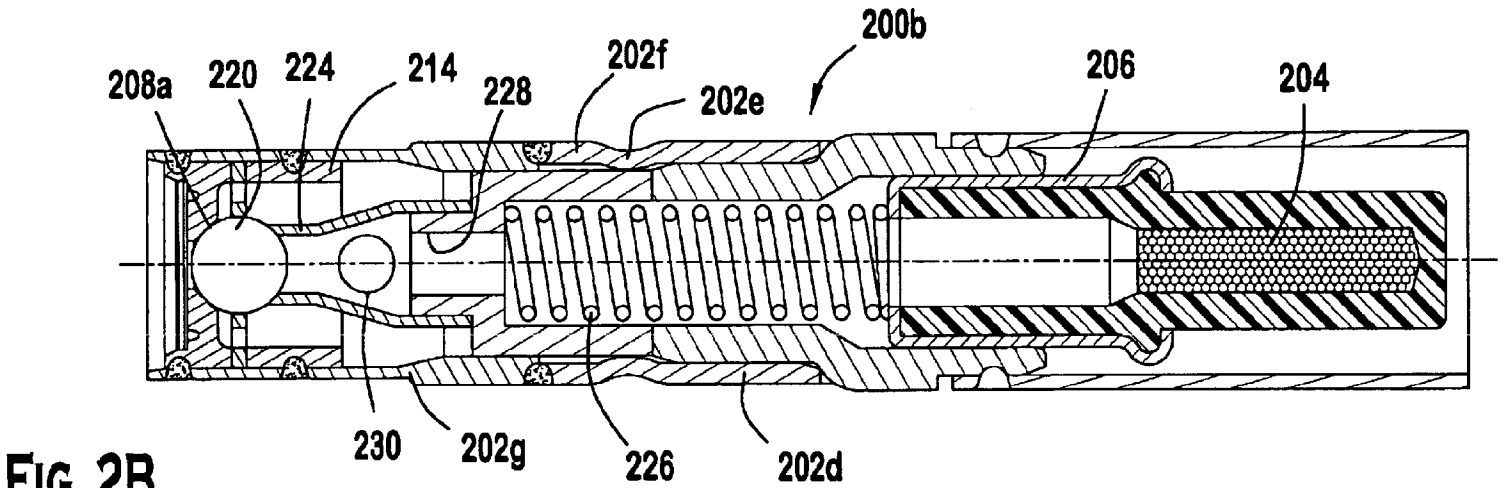
FIG. 2B illustrates a cross-sectional view of the components of yet another preferred embodiment of the valve group subassembly.

The valve group subassembly 200 can include a suitable fuel injection valve and its associated components to meter fuel and which are independently assembled from a magnetic motive source. Referring to FIG. 2, the valve group subassembly 200 has an inlet tube assembly 202 extending between a tube inlet 202*a* and a tube outlet 202*b* along a valve group subassembly axis 216. Preferably, the valve group subassembly 200 includes an exterior tube assembly having a generally constant cross-sectional area along the axis 216. The inlet tube assembly 202 can be formed as a unitary unit with a pole piece 202*c* (FIG. 2A). In such preferred embodiment, the unitary tube assembly forms a pole piece 202*c* (FIG. 2A); the pole piece 202*c* is connected to a first end 202*d* of a non-magnetic shell 202*e*; the non-magnetic shell 202*e* has a second end 202*f* connected to a valve body 202*g*. The non-magnetic shell 202*e* can be formed from non-magnetic stainless steel, e.g., 300 series stainless steels, or other materials that have similar structural and magnetic properties. Where the tube assembly is formed from more than one unitary piece, the tube assembly preferably includes a tube inlet tube 202 connected to a pole piece 202*c*; the pole piece 202*c* is connected to a first end 202*d* of a non-magnetic shell 202*e*; the non-magnetic shell 202*e* has a second end 202*f* connected to a valve body 202*g*. The tube inlet 202*a* may include a filter 204 coupled to a preload adjuster 206 (FIG. 2 or 2B) or the filter 204 can be mounted in the fuel supply such that only the preload adjuster 206 is mounted in the inlet tube assembly 202 (FIG. 2A).

The valve body 202*g* contains a seat 208, orifice plate 210, closure assembly 212 and a lift setting sleeve 214. The seat 208 includes a generally conical seating surface 208*a* disposed about the valve group subassembly axis 216 and a seat orifice 218 co-terminus with the generally conical seating surface. The seat 208 has an orifice plate 210 disposed proximate the seat orifice 218. The closure assembly 212 includes a closure member 220, preferably a spherical shaped member, coupled to an armature 222 via an armature tube 224. The armature 222 has an internal armature pocket 222*a* to receive a preload spring 226, which is disposed partly in the inlet tube assembly 202 and preloaded by a preload adjuster 206. Extending through the armature 222 and armature tube 224 is a through-bore 228 with apertures 230 formed on the surface of the armature tube 224 to permit fuel to flow from the inlet tube towards the seat 208. The apertures 230, which can be of any shape, are preferably non-circular, e.g., axially elongated, to facilitate the passage of gas bubbles. For example, in the case of a separate intermediate portion or tube 224 that is formed by rolling a sheet substantially into a tube, the apertures 230 can be an axially extending slit defined between non-abutting edges of the rolled sheet. However, the apertures 230, in addition to the slit, would preferably include openings extending through the sheet. The apertures 230 provide fluid communication between the at least one through-bore 228 and the interior of the valve body. Thus, in the open configuration, fuel can be communicated from the through-bore 228, through the apertures 230 and the interior of the valve body, around the closure member 220, through the opening 208 of the seat and through metering orifices formed through an orifice plate 210 into the engine (not shown).

The armature 222 is disposed in the tube assembly 202 such that a ferromagnetic portion 222*b* can be spaced through a working gap in a closed position of the armature and contiguous to the pole piece 202*c* in an open position of the armature 222. The spherical valve element 220 is moveable with respect to the seat 208 and its generally conical sealing surface 208*a*. The closure element 220 is movable between a closed configuration, as shown in FIGS. 1 and 2, and an open configuration (not shown). In the closed configuration, the closure member 220 contiguously engages the sealing surface 208*a* to prevent fluid fuel flow through the seat orifice 208. In the open configuration, the closure member 220 is spaced from the seat 208 to permit fuel flow through the opening.

The intermediate portion or armature tube 224 can be fabricated by various techniques, for example, a plate can be rolled and its seams welded or a blank can be deep-drawn to form a seamless tube. The intermediate portion 224 is preferable due to its ability to reduce magnetic flux leakage from the magnetic circuit of formed by the assembly of a fuel injector from the subassemblies. This ability arises because the armature tube 224 can be non-magnetic, thereby magnetically decoupling the magnetic portion or armature 222 from the ferro-magnetic closure member 220. Because the ferro-magnetic closure member is decoupled from the ferro-magnetic or armature 222 via the preferably non-magnetic armature tube 224, flux leakage is reduced and, thereby the magnetic decoupling is believed to improve the efficiency of the magnetic circuit.

Surface treatments can be applied to at least one of the end portions of the armature or the pole piece to improve the armature's response, reduce wear on the impact surfaces and variations in the working air gap between the respective impacting end portions of the armature and pole piece. The surface treatments can include coating, plating or case-hardening. Coatings or platings can include, but are not limited to, hard chromium plating, nickel plating or keronite coating. Case hardening on the other hand, can include, but are not limited to, nitriding, carburizing, carbonitriding, cyaniding, heat, flame, spark or induction hardening.

In the case of a spherical valve element providing the closure member 220, the spherical valve element can be connected to the closure assembly 212 at a magnitude that is less than the diameter of the spherical valve element. Such a connection would be on the side of the spherical valve element that is opposite contiguous contact with the seat 208. A lower armature guide 232 can be disposed in the tube assembly, proximate the seat 208, and would slidingly engage the diameter of the spherical valve element. The lower armature guide 232 can facilitate alignment of the closure assembly 212 along the valve axis The valve group subassembly 200, as described above, can be calibrated and tested (i.e., pre-calibrated) prior to its installation in the air-fuel module 10. Other configurations of an independently operable and testable valve group subassembly 200 are provided as subassemblies 200*a* and 200*b* in FIGS. 2A and 2B, respectively. Details of the valve group subassembly 200, including valve subassemblies 200*a* and 200*b*, including other preferred embodiments, are described and illustrated in U.S. Patent Publication No. 20020047054, entitled "Modular Fuel Injector And Method Of Assembling The Modular Fuel Injector" and published on Apr. 25, 2002, which is hereby incorporated by reference in its entirety.

Figure 3:
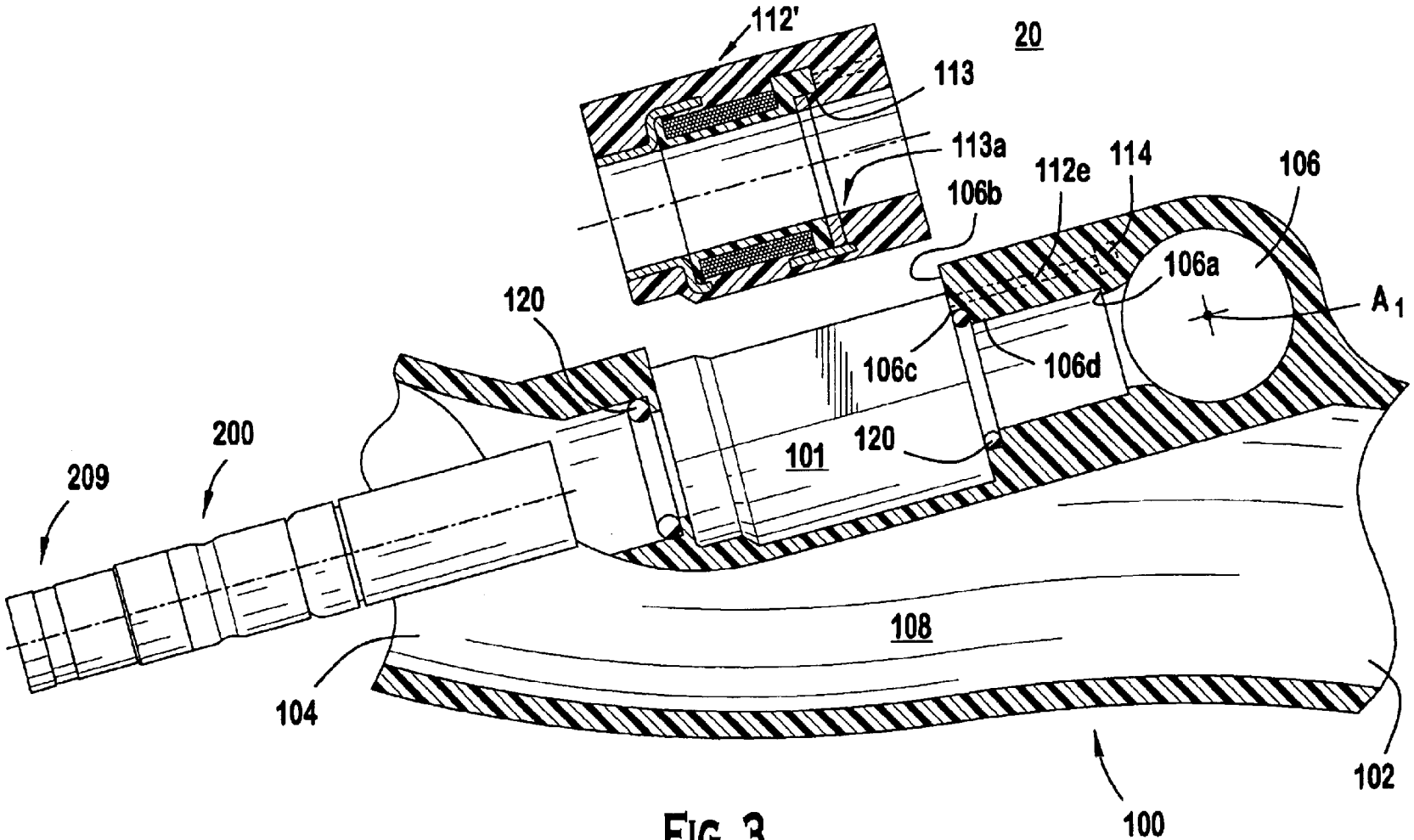
FIG. 3 illustrates an alternate preferred embodiment of the air-fuel module of FIG. 1 in an unassembled position.
Figure 3A:
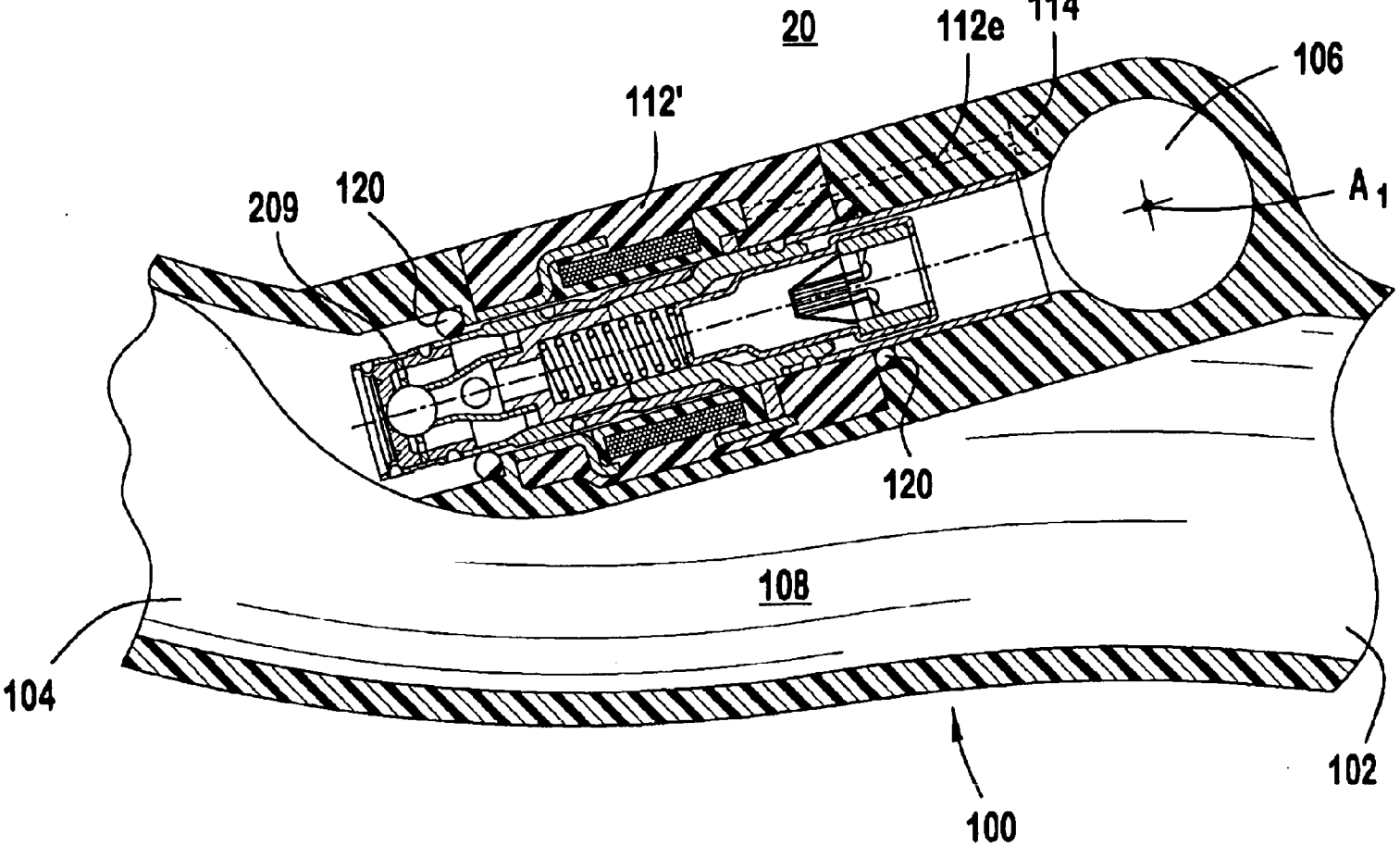
FIG. 3A illustrates the air-fuel module of FIG. 3 in an assembled position.
Figure 3B:
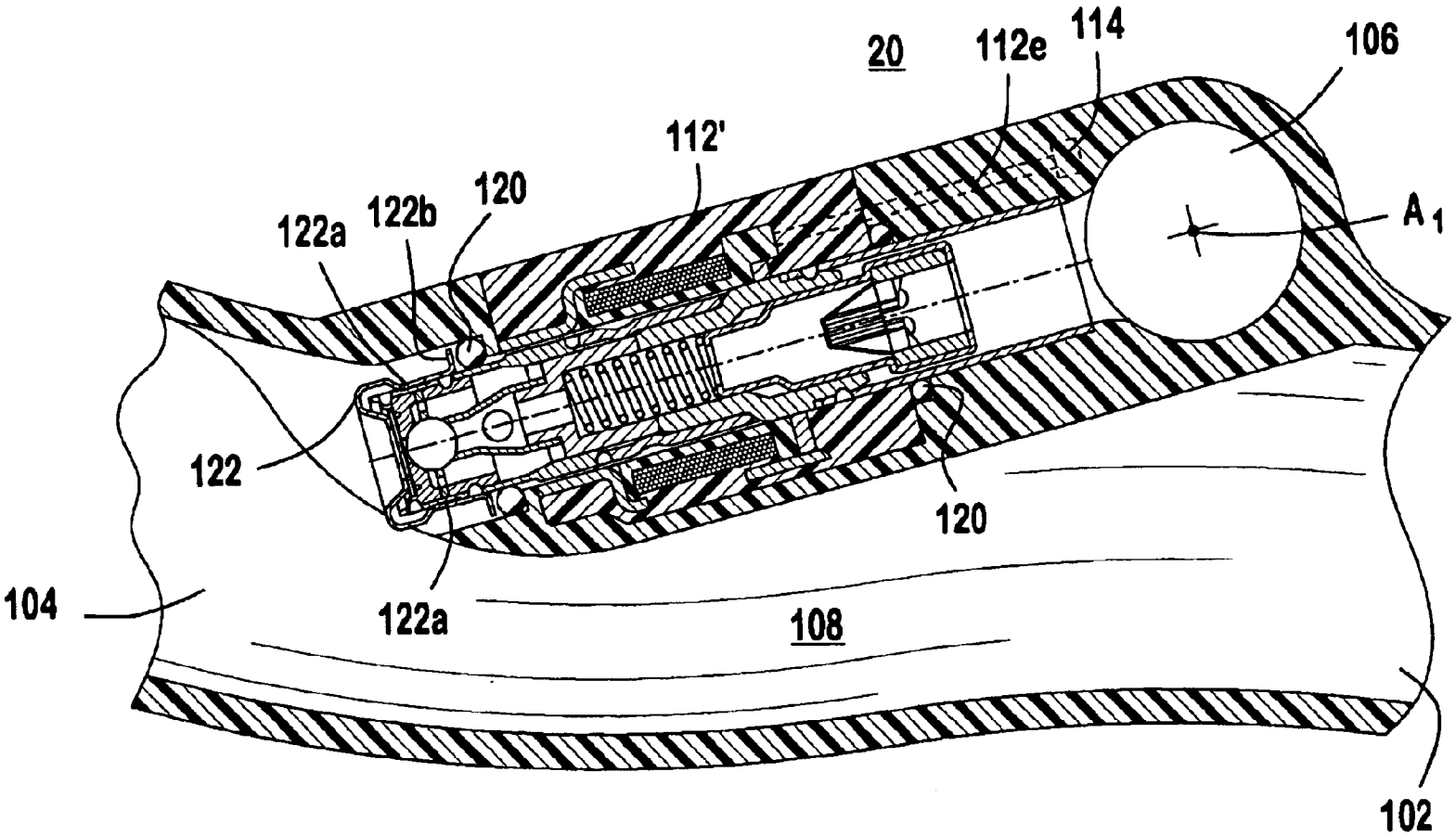
FIG. 3B illustrates a sealing member retainer for the valve group subassembly of FIG. 3A.

Referring to FIG. 3, the power group subassembly 112' of the module can be formed as a separate component from a manifold. In particular, the second wall portion 113 and the power group subassembly 112' can be overmolded into a component separate from the manifold 20. The manifold 20 is provided with a recess 101 disposed between the fuel supply passage 106 and each of the air supply passages 108. The recess 101 can be formed by respective boss portions 106*b*, 104*a* of the fuel supply and air supply passages 108. The fuel supply boss portion 106*b* can be provided with a first stepped portion 106*c* that limits movement of the power group subassembly 112 in the recess 101 and a second stepped portion 106*d* that limits movement of a suitable sealing member 120 such as, for example, an O-ring. The air supply boss portion 104*a* can be provided with a flange 104*b* that limits the axial movement of the separate power group subassembly 112' and a suitable sealing member 120, such as, for example, an O-ring. The sealing member 120 can be provided with a retainer 122 with resilient finger-like locking portions 122*a* that couple the retainer 122 (FIG. 3B) to mating recesses 209 formed on the valve body 202*g* to generally prevent excessive movement of the sealing member 120 towards the air supply outlet 104. The finger-like locking portions 122*a* allow the retainer 122 to be snap-fitted on a complementarily grooved portion 209 of the valve body 202*g*. To ensure that the retainer 122 is imbued with sufficient resiliency, the thickness of the retainer 122 should be at most one-half the thickness of the valve body 202*g*. A flange portion 122*b* of the retainer 122 also supports the sealing member 120.

To permit control of the power group subassembly 112', the fuel supply boss portion 106*b* can be provided with electrical connectors 112*e* that contact the respective coil wire 112*a* of the separate power group subassembly 112' when the separate power group subassembly 112' is inserted into the recess 101.

Figure 4:
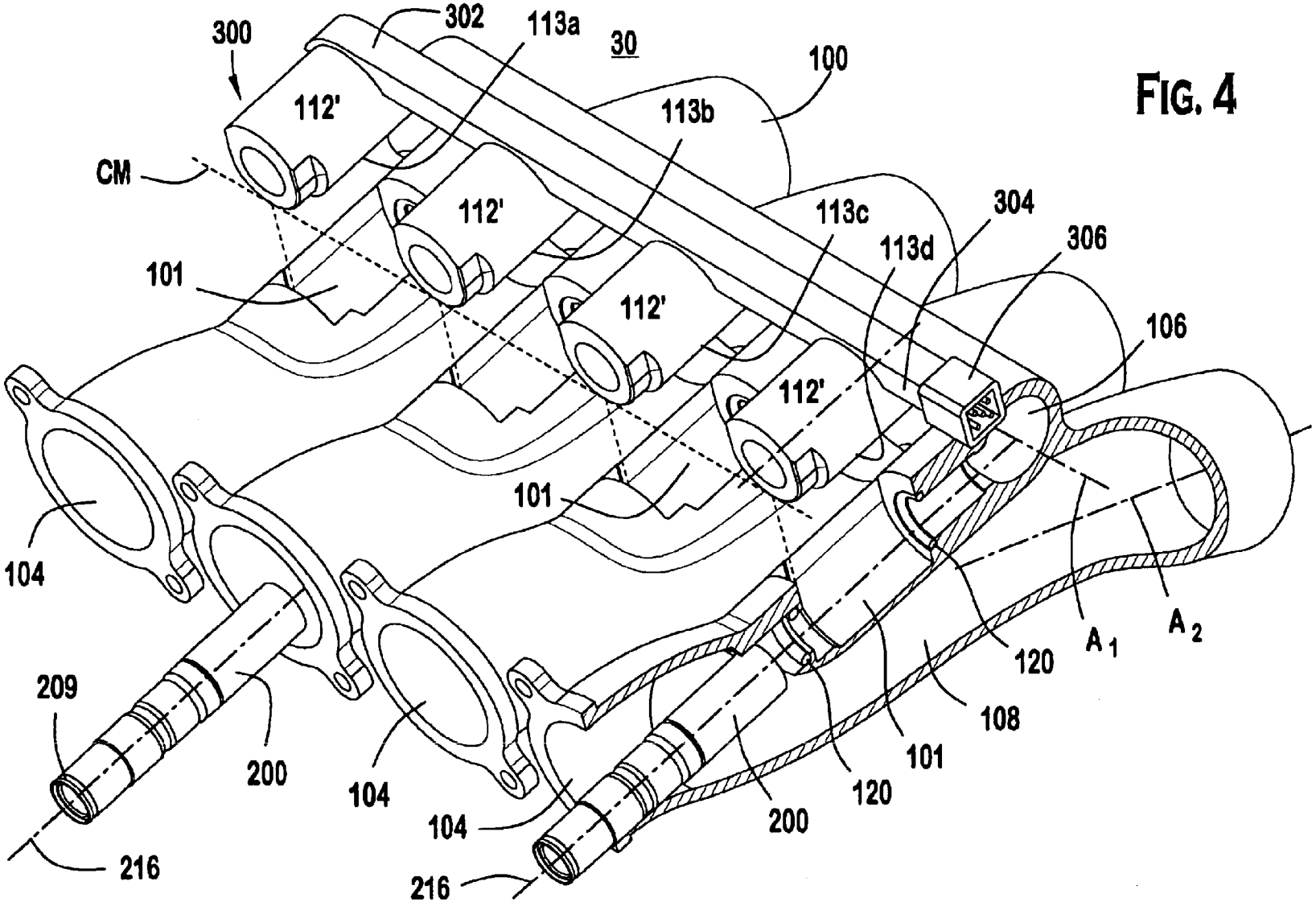
FIG. 4 is a perspective view of the air-fuel module of FIG. 3.

In another preferred embodiment of an air-fuel module 30, a unitary power module 300 can be formed by interconnecting a bar 302 with each of a plurality of power subassemblies 112', shown here in FIG. 4. The bar 302 allows the plurality of power subassemblies to be structurally connected together, oriented in a desired mounting configuration and locked to the manifold 100 upon securement of the valve group subassembly to at least one of the power group subassembly or the manifold 100. Where the air supply passages are generally identical, the bar 302 orients each of the power subassemblies so that respective perimeter portions 113*a*, 113*b*, 113*c*, 113*d* are contiguous to a virtual common plane CM generally parallel to the common inlet 102 and the respective outlets 104. Where the air supply passages 108 are not identical, the bar 302 also allows specific orientations of each of the power subassemblies 112' to accommodate the specific orientation of the air supply passages 108. Regardless of the configuration of the air supply passages 108 or manifold, the bar 302 permits the to be placed into its respective recesses 101 in a single operation. Additionally, upon insertion of the valve group subassembly 200, the power group subassemblies are now generally fixed to a position within the recess 101. Preferably, the air supply passages 108 are generally identical such that the respective portions 113*a*, 113*b*, 113*c*, 113*d* are contiguous to a common plane generally parallel to the common inlet 102 and the respective outlets 104.

Furthermore, the bar 302 allows the plurality of power subassemblies 112' to be electrically connected to a common harness 304 (disposed within the bar 302) and to a common electrical connector 306 instead of electrical connectors and harness formed as part of the manifold 20 for each of the separate power group subassembly 112'. The connector 306 can be formed at a suitable position on the bar so that the connector 306 can be connected to a fuel injection harness connector (not shown).

The air-fuel module 10 can be assembled as follows. A valve group subassembly 200 is inserted into the manifold 100 through the respective air supply outlet 104 into the chamber 110 so that the valve inlet 202*a* is adjacent the fuel supply passage 106. The fuel supply passage 106 can be formed with a positive stop portion 106*a* so that when the valve group subassembly 200 reaches an axially desired position within the chamber 110, the inlet tube is prevented from intruding into the fuel supply passage 106. The air fuel module 20 can be assembled as follows. A sealing member 120 can be placed in a position proximate the first and second stepped portions 106*c*, 106*d* of the fuel boss portion 106*b*. Another sealing member 120 can be inserted through the respective air outlets 104 to be placed adjacent a flange 104*b* of the air supply boss portion 104*a*. Each of a plurality of separate power subassemblies 112' can be placed in the recess 101. The valve group subassembly 200 can be inserted through the respective air outlets 104 into the chamber 110 defined by each of the power subassemblies 112' until the valve inlet 202 is prevented from further axial movement by stop portion 106*a*. Where a power module 300 is used, the power module 300 is placed into position so that each of the power subassemblies 112' is disposed in the recess 101 to form air-fuel module 30. Thereafter, each valve group subassembly 200 can be inserted through the respective air outlets 104 into the chamber 110 defined by each of the power subassemblies 112' until the valve inlet 202 is prevented from further axial movement by stop portion 106*a*.

The valve group subassembly 200 can be rotated angularly about the valve assembly axis 216 so that a suitable spray pattern or spray targeting can be generated downstream of the respective air outlets 104. Index markings visible through air outlet 104 can be formed on the surface of the valve group subassembly 200 and on the surface of the chamber for adjustment of the angular position of the valve group subassembly relative to the chamber. When the angular and axial positions of the valve group subassembly 200 have reached the respective desired positions in the chamber 110, a suitable technique such as crimping, welding or bonding can be used to secure the valve group subassembly 200 to the chamber 110. Where the separate power subassemblies 112' are used instead of the unitary power subassemblies 112, the sealing member retainer 122 can be inserted through the air supply outlet 104. Thereafter, the assembled air-fuel module 10 or 20 can be assembled to the engine and a fuel supply can be connected to the fuel supply passage 106 so that the air fuel module 10 or 20 can meter air and fuel into the engine for operating the engine.

In operation, the electromagnetic coil 112*a* is energized, thereby generating magnetic flux in the magnetic circuit. The magnetic flux moves the closure assembly 212 towards the pole piece 202*c*, i.e., closing the working air gap. This movement of the closure assembly 212 separates the closure member 22 from the seat 208 and allows fuel to flow from the fuel supply passage 106, through the inlet tube 202*a*, the through-bore 228, the apertures 230 and the valve body 202*g*, between the seat 208 and the closure member 220, through the opening 208*a*, and finally through the orifice plate into the internal combustion engine (not shown). When the electromagnetic coil 112*a* is de-energized, the closure assembly 212 is moved by the bias of the resilient member to contiguously engage the closure member 220 with the seat 208, and thereby prevent fuel flow to the air supply passage.

While the present invention has been disclosed with reference to certain embodiments, numerous modifications, alterations and changes to the described embodiments are possible without departing from the sphere and scope of the present invention, as defined in the appended claims. Accordingly, it is intended that the present invention not be limited to the described embodiments, but that it has the full scope defined by the language of the following claims, and equivalents thereof.

What we claim is:

1. An air-fuel module comprising:

a manifold including a first portion defining a fuel supply passage and at least one air supply passage, and a second portion including a surface defining a chamber that provides a passageway to allow communication with the fuel supply passage and the at least one air supply passage;

a power group subassembly having a coil surrounding the surface; and a valve group subassembly disposed within the chamber.

2. The air-fuel module of claim 1, wherein the chamber comprises a generally cylindrical chamber having a generally constant cross-sectional area about a longitudinal axis defined by the chamber.

3. The air-fuel module of claim 2, wherein the first and second wall portions comprise a unitary wall portion of the manifold.

4. The air-fuel module of claim 3, wherein the valve group subassembly comprises a first connecting portion fixedly connected to a second connecting portion of the power group subassembly such that the valve group subassembly is located within the manifold at a fixed angular position relative to the longitudinal axis.

5. The air-fuel module of claim 1, wherein the valve group subassembly comprises a tube assembly having a generally constant cross-sectional area, the tube assembly including:

a pole piece proximate the valve inlet;

a seat proximate the valve outlet and defining an opening;

an armature disposed between the valve inlet and valve outlet, the armature being spaced at a working gap from the pole piece in one position of the armature;

a member biasing the armature along an axis of the tube assembly towards the seat; and a closure member connected to the armature, the closure member being movable along the axis between a first position occluding fuel flow through the valve outlet and a second position permitting fuel flow through the valve outlet.

6. The air-fuel module of claim 5, wherein the valve group subassembly comprises a pre-calibrated valve group subassembly calibrated to at least one of a preset flow rate and working gap prior to being located in the chamber of the manifold.

7. The air-fuel module of claim 5, wherein the tube assembly further comprises:

an inlet tube proximate the inlet connected to a first shell end of a non-magnetic shell and a valve body proximate the valve outlet connected to a second shell end of the non-magnetic shell;

a filter located within the inlet tube proximate the pole piece, the filter engaging the member and adjusting a biasing force of the member on the armature, the filter including a conical end projecting towards the seat and spaced from the member; and a lift setting sleeve contiguous to the valve body and the seat so that the lift sleeve defines a working gap between the pole piece and the armature.

8. The air-fuel module of claim 7, wherein the power group subassembly comprises:

an electromagnetic coil disposed about the chamber, the electromagnetic coil having a coil wire formed over a bobbin, the bobbin being supported by a coil housing being magnetically coupled to a flux washer disposed about the chamber; and a common electrical harness formed within the manifold, the common electrical harness electrically connecting the coil wire to an electrical connector formed as a unitary unit with the manifold.

9. The air-fuel module of claim 8, wherein the second wall portion comprises a wall portion separate from the first wall portion of the manifold, the separate wall portion being removable from the manifold.

10. The air-fuel module of claim 9, wherein the power group subassembly comprises a plurality of power subassemblies each having a structural member interconnecting the plurality of power subassemblies together such that the structural member orients each power group subassembly with respect to a common plane extending through a first axis of the fuel passage.

11. The air-fuel module of claim 10, wherein the structural member further comprises an electrical connector disposed on the structural member, the electrical connector being electrically connected to each of the plurality of power subassemblies.

12. The air-fuel module of claim 10, wherein the first wall portion comprises an air boss portion facing a respective fuel boss portion along the air supply passage, the air and fuel boss portions mating with respective boss portions of each of the plurality of the coil group subassemblies.

13. A method of forming an air-fuel module having a valve group subassembly, and a manifold including first and second wall portions, the first wall portion having a fuel supply passage and at least one air supply passage extending between an inlet and an outlet, the second wall portion having a wall surface defining a chamber, the method comprising:

surrounding the wall surface of the chamber with a coil of a power group subassembly; and inserting the valve group subassembly into the chamber.

14. The method of claim 13, wherein the inserting further comprises orientating the valve group subassembly about a chamber axis extending through the chamber to achieve a spray targeting pattern sufficient to atomize fuel with air flowing through the respective outlet.

15. The method of claim 14, wherein the inserting further comprises pre-calibrating the valve group subassembly to at least one of a preset fuel flow rate and a working gap between a pole piece and armature of the valve group subassembly prior to being inserted in the chamber.

16. The method of claim 15, wherein the locating comprises insert-molding in the second wall portion an electromagnetic coil having a coil wire formed over a bobbin, the bobbin being supported by a coil housing magnetically coupled to a flux washer disposed about the longitudinal axis.

17. The method of claim 16, wherein the inserting further comprises forming a hermetic seal between the valve group subassembly and one of a portion of the coil housing and the at least one air supply passage.

18. The method of claim 17, wherein the insert-molding comprises molding a power group subassembly as a unitary member of the second wall portion.

19. The method of claim 17, wherein the insert-molding comprises molding a power group subassembly in the second wall portion separate from the first wall portion such that the inserting fixes the second wall portion in a recess defined by the first wall portion disposed between the fuel supply and air supply passages.

20. The method of claim 19, wherein the locating further comprises:

providing a plurality of air supply passages having a common inlet and a plurality of respective air outlets with respective recesses disposed therebetween;

locating the pre-assembled power subassemblies into respective recesses; and interconnecting a structural member between each of the plurality of pre-assembled power subassemblies such that each of the plurality of power subassemblies is contiguous to a common plane generally parallel to an axis of the fuel supply passage.

21. The method of claim 20, wherein the forming comprises retaining the power group subassembly and valve group subassembly to the chamber via a securement between at least one of the air supply passage and the power group subassembly.

22. The method of claim 21, wherein the securement comprises at least one laser weld extending through a portion of the air supply passage and a portion of the valve group subassembly that forms the hermetic seal.

23. A power module for a fuel injection system comprising:

a unitary housing having a first housing portion interconnecting a plurality of second housing portions that are spaced apart along a first axis, each of the plurality of the second housing portions molded around each of a plurality of power subassemblies, the first housing portion including a common electrical connector in electrical communication with the plurality of power subassemblies.

24. The power module of claim 23, wherein the first housing portion comprises electrical wires molded within the first housing portion.

25. The power module of claim 24, wherein each of the second housing portions comprises a wall extending from a first housing wall end to a second housing wall end along a longitudinal axis, the wall surrounding the power subassembly and the longitudinal axis to define an aperture that receives a valve group subassembly, the aperture extending along the longitudinal axis.

26. The power module of claim 25, wherein the aperture comprises an aperture having a generally constant cross-sectional area along the longitudinal axis from the first housing wall end to the second housing wall end.

27. The power module of claim 26, wherein each of the power subassemblies comprises an electromagnetic coil disposed in the wall to surround the longitudinal axis so that the coil surrounds the aperture, the electromagnetic coil having a coil wire formed over a bobbin and electrically connected to the common connector of the first housing portion, the bobbin being supported by a coil housing being magnetically coupled to a flux washer disposed about the aperture.

28. The power module of claim 27, further comprising a valve group subassembly disposed in the aperture of each of the plurality of second housing portions and secured to the second housing portion.

29. The power module of claim 28, wherein the valve group subassembly comprises a tube assembly having a generally constant cross-sectional area extending between inlet and outlet ends of the tube assembly, the tube assembly including:

a pole piece proximate the inlet end;

a seat proximate the outlet end and defining an opening;

an armature disposed between the inlet end and outlet end, the armature being spaced at a working gap from the pole piece in one position of the armature;

a member biasing the armature along an axis of the tube assembly towards the seat; and a closure member connected to the armature, the closure member being movable along the axis between a first position occluding fuel flow through the outlet end and a second position permitting fuel flow through the outlet end.

30. The power module of claim 29, wherein the tube assembly further comprises:

an inlet tube proximate the inlet connected to a first shell end of a non-magnetic shell and a valve body proximate the valve outlet connected to a second shell end of the non-magnetic shell;

a filter located within the inlet tube proximate the pole piece, the filter engaging the member and adjusting a biasing force of the member on the armature, the filter including a conical end projecting towards the seat and spaced from the member; and a lift setting sleeve contiguous to the valve body and the seat so that the lift sleeve defines a working gap between the pole piece and the armature.

31. The power module of claim 30, wherein the valve group subassembly comprises a pre-calibrated valve group subassembly calibrated to at least one of a preset flow rate and working gap prior to insertion in the aperture of each of the second housing portions.

* * * * *